US006357424B1

(12) United States Patent
Sonoda et al.

(10) Patent No.: US 6,357,424 B1
(45) Date of Patent: Mar. 19, 2002

(54) FUEL PUMP UNIT OF MOTORCYCLE

(75) Inventors: Yuji Sonoda, Shizuoka-Ken; Tetsuo Nojima, Hamamatsu, both of (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/510,677

(22) Filed: Feb. 22, 2000

(30) Foreign Application Priority Data

Feb. 22, 1999 (JP) ..... 11-043339

(51) Int. Cl.[7] ..... F02M 37/04
(52) U.S. Cl. ..... 123/509; 123/184.21; 180/219
(58) Field of Search ..... 123/509, 442, 123/470, 73 C, 184.21–184.61; 180/219

(56) References Cited

U.S. PATENT DOCUMENTS 3,901,204 A * 8/1975 Jaulmes ..... 123/495
4,413,700 A * 11/1983 Shiratsuchi ..... 180/219
4,648,474 A * 3/1987 Shinozaki et al. ..... 180/219
4,978,282 A * 12/1990 Fu et al. ..... 417/360
5,233,652 A * 8/1993 Huang et al. ..... 380/7
5,255,643 A * 10/1993 Mochizuki et al. .... 123/179.17
5,775,289 A * 7/1998 Yoshida et al. ..... 123/305
6,039,029 A * 3/2000 Nagasaka et al. ..... 123/442
6,142,123 A * 11/2000 Galasso et al. ..... 123/486

* cited by examiner

*Primary Examiner*—Carl S. Miller
(74) *Attorney, Agent, or Firm*—Oblon, Spivak, McClelland, Maier & Neustadt, P.C.

(57) ABSTRACT

In a motorcycle, an engine is arranged at a lower portion of substantially a center portion of a motorcycle body between a front wheel, a rear wheel and a fuel tank is arranged above the engine and the motorcycle is provided with a fuel pump unit. The engine has a plurality of cylinders and is formed at a rear portion thereof with an intake port to which an air-fuel fuel mixture supply means is connected and the fuel pump for supplying fuel in the fuel tank to the air-fuel mixture supply means is attached integrally to the air-fuel mixture supply means.

9 Claims, 9 Drawing Sheets

FUEL PUMP UNIT OF MOTORCYCLE

BACKGROUND OF THE INVENTION

The present invention relates to a fuel pump unit of a motorcycle.

In a motorcycle, a mixture air is supplied to an engine by using a carburetor or, in an improvement, a fuel is injected into an intake passage of a throttle body connecting an air cleaner to an engine by using an injector. In the case of the fuel injection system, it is necessary to arrange a fuel pump for pressurizing the fuel, for example, in a fuel tank (refer to Japanese Patent Laid-Open Publication No. HEI 5-99089), or the pump is mounted, for example, to a body frame outside the fuel tank (refer to Japanese Patent Laid-Open Publication No. SHO 57-191173).

By the way, in the case where a discharge pressure of a fuel pump increases to a predetermined value or more, normally, a pressure regulator provided on the most downstream side of a fuel flow passage is opened to restore the excessive fuel into the fuel tank.

However, in the case of providing the fuel pump in the fuel tank, a wide place for installing the fuel pump is necessary in the tank, especially at the bottom surface of the tank, and a shape or a layout of the fuel tank is limited.

Furthermore, a high sealing performance is required between the bottom surface of the fuel tank and the installation surface of the fuel pump. However, the fuel tank is generally made of a steel sheet, and therefore, it is difficult to realize a high sealing performance.

Moreover, when the fuel pump is provided in the fuel tank, the capacity of the tank is reduced.

On the other hand, in the case of arranging the fuel pump outside the fuel tank, although the fuel pump is attached to a part of the body frame, it is necessary to use a high pressure hose for connecting the fuel pump and the throttle body, and therefore, it is undesired to widen the distance between the fuel pump and the throttle body.

That is, when the high pressure hose becomes longer, it becomes difficult to keep the air tightness, it becomes necessary to wind a protector or the like around the outer surface of the hose, and the layout becomes complex so as not to interfere with other parts, providing many problems.

In a case where the fuel pump can be arranged near the throttle body, the high pressure hose becomes shorter, but there are many cases where other equipments are attached to the body frame near the throttle body. Therefore, in some cases, it is difficult to mount the fuel pump .

Furthermore, when the fuel pump is attached to the body frame near the throttle body, it is necessary to simultaneously remove the fuel pump when removing the engine or the throttle body (since the high pressure hose is short), which results in a bad maintenance performance.

On the other hand, in a pump for feeding fuel, when the fuel pump is positioned above the fuel outlet of the fuel tank, it is necessary for the fuel pump to simultaneously suck the fuel, and the load on the pump is increased as the difference in location levels becomes larger. As a result, there is a possibility that the fuel cannot stably be supplied, and there is also a possibility that the pump becomes large-sized for the stable supply of the fuel.

Moreover, when the pressure regulator is provided on the most downstream side of the fuel flow passage, the piping becomes long and complex, thus being inconvenient.

SUMMARY OF THE INVENTION

An object of the present invention is to substantially eliminate defects or drawbacks encountered in the prior art mentioned above and to provide a fuel pump unit of a motorcycle capable of making short a high pressure hose and providing a high maintenance performance.

This and other objects can be achieved according to the present invention by providing a fuel pump unit of a motorcycle in which an engine is arranged at a lower portion of substantially a center portion of a motorcycle body between a front wheel and a rear wheel and a fuel tank is arranged above the engine, wherein the engine is formed, at a rear portion thereof, with an intake port to which an air-fuel mixture supply means is connected and a fuel pump for supplying fuel in the fuel tank to the air-fuel mixture supply means is attached integrally to the air-fuel mixture supply means.

In a preferred embodiment, the engine has a plurality of cylinders to which the intake ports are formed, respectively, and the air-fuel mixture supply means is connected to the intake port formed to each cylinder. A plurality of air-fuel mixture supply means are integrally connected by a connection plate and the fuel pump is mounted integrally to the air-fuel mixture supply means through a stay extending from the connection plate.

The air-fuel mixture supply means has a fuel injection type structure. The air-fuel mixture means is disposed between a lower portion of the fuel tank and the upper portion of the engine and comprises a throttle body provided with a fuel injector. The fuel pump is provided with a pressure regulator to regulate a pressure of the fuel and then to supply a fuel to the air-fuel mixture supply means.

The engine has a plurality of cylinders to which the intake ports are formed and the fuel pump is arranged so that a longitudinal axis thereof is arranged substantially in parallel with a row of the plurality of cylinders. The engine may have a plurality of cylinders to which the intake ports are formed and the fuel pump is arranged so that a longitudinal axis thereof is arranged substantially in parallel with an axis of the plurality of cylinders, the fuel pump being arranged so that a fuel inlet thereof is positioned to a lowermost position. Furthermore, the engine may have a plurality of cylinders to which intake ports are formed and the fuel pump is arranged so that a longitudinal axis thereof is arranged substantially at right angles with a row of the plurality of cylinders, the fuel pump being arranged so as to be inclined backward downward so that a fuel inlet thereof is positioned to a lowermost position.

According to the fuel pump unit of a motorcycle of the present invention of the characters mentioned above, in the motorcycle, the engine is arranged at the lower portion of the center of the motorcycle body between the front wheel and the rear wheel and the fuel tank is arranged above the engine. The air-fuel mixture supply means is connected to the intake port formed at the rear portion of the engine. In addition, the fuel pump for supplying the fuel is attached integrally to the mixture supply means. Therefore, the shape and layout of the fuel tank are not specifically limited, and the inner volume of the fuel tank can be kept properly, and it is also not necessary to consider the sealing performance between the fuel tank and the fuel pump. Furthermore, the high pressure hose for connecting the mixture supply means and the fuel pump can be made short. Moreover, the mixture supply means and the fuel pump can be unitized, and the performance of maintenance can be improved.

Still furthermore, the engine has a plurality of cylinders, and the mixture supply means is connected to each of the intake ports formed to each cylinder. The mixture supply means are integrally connected by a connection plate, and the fuel pump is attached integrally to the mixture supply means through the stay integrally extending from the connection plate. Therefore, the mixture supply means and the fuel pump are unitized, and the performance of maintenance can be improved thereby to increase the degree of freedom in the installation position and direction of the fuel pump.

Furthermore, the fuel mixture supply means is a fuel injection type, which is constituted so that a pressure regulator is provided in the fuel pump and the fuel is supplied to the mixture supply means after regulating the pressure of fuel in advance. Therefore, a long complex piping is unnecessary, and the amount of the fuel injection is also made stable.

Still furthermore, since the fuel pump is arranged so that a longitudinal axis thereof is almost in parallel with a row of the plurality of cylinders, the space behind and under the fuel pump can be expanded.

Still furthermore, the fuel pump is arranged so that a longitudinal axis thereof is almost in parallel with an axis of the plurality of cylinders and the fuel pump is arranged so that a fuel inlet thereof is arranged at the lowermost position. Therefore, the space behind the fuel pump can be expanded, and a stable fuel supply can be realized.

Still furthermore, the fuel pump is arranged so that a longitudinal axis thereof is arranged at right angles with a row of the plurality of cylinders and the fuel pump is arranged to the lower backward position so that the fuel inlet thereof is arranged at the lowermost position. Therefore, the space under the fuel pump can be also expanded and a stable fuel supply can be also realized. The vapor lock of the fuel can be prevented, and further, the fuel hose connecting the fuel tank and the fuel pump can be shortened.

The nature and further characteristic features of the present invention will be made more clear from the following descriptions made with reference to the accompanying drawings.

DESCRIPTION OF THE PREFERRED EMBODIMENTS

An embodiment of the present invention will be described hereunder with reference to the accompanying drawings.

Figure 1:
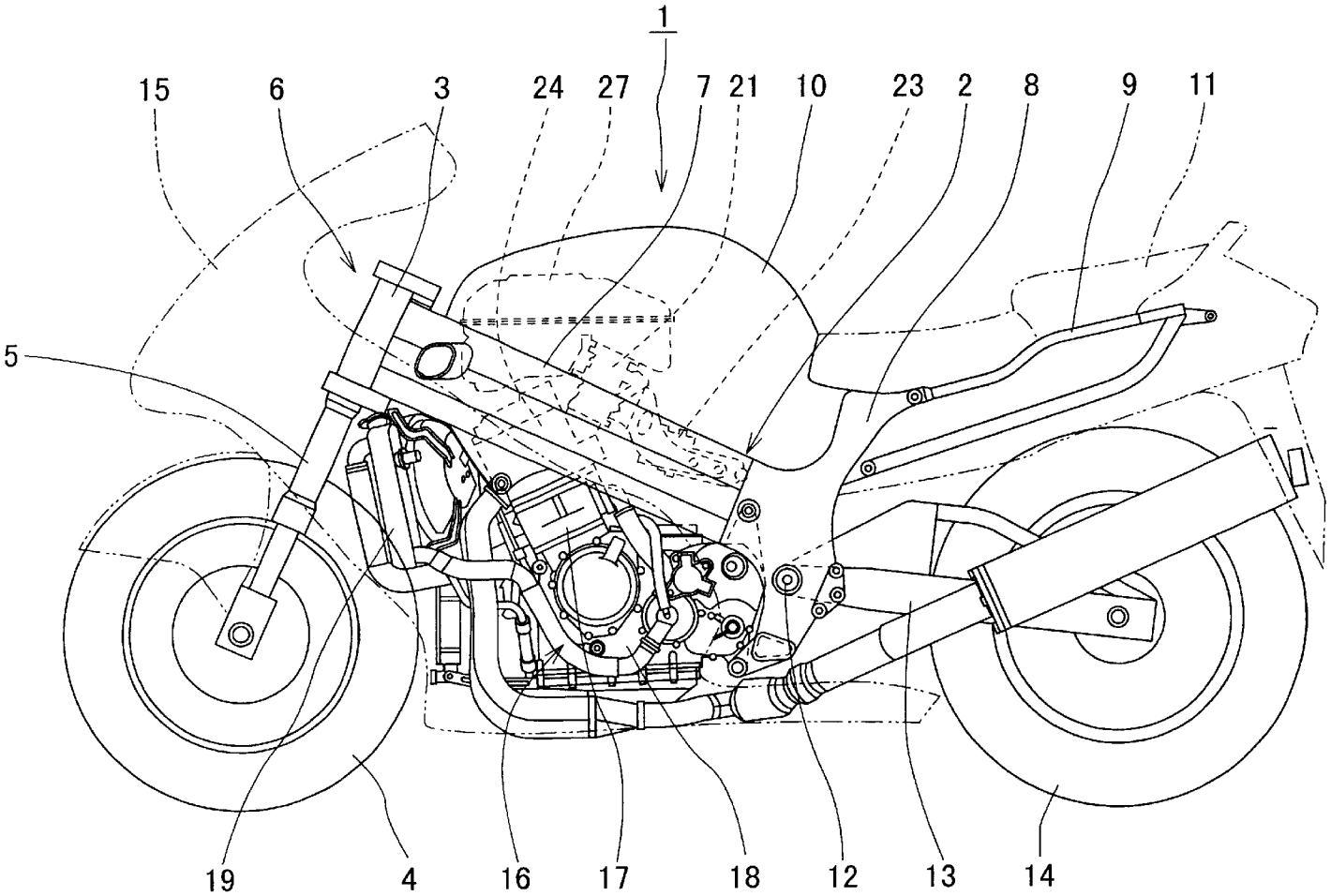
FIG. 1 is a left side view of a motorcycle provided with a fuel pump unit of a motorcycle according one embodiment of the present invention.

FIG. 1 is a left side view showing one example of a motorcycle to which the present invention is applicable. With reference to FIG. 1, the motorcycle 1 has a body frame 2 and a head pipe 3 provided in front of the body frame 2. In the head pipe 3, a suspension mechanism, not shown, is located, and a steering mechanism 6 constituted from a pair of left and right front forks 5 which rotatably support a front wheel 4 or the like is also provided.

On the other hand, the body frame 2 is, for example, a frame having a twin-tube structure, which comprises a pair of left and right tank rails 7 extending in parallel with each other diagonally backward and downward after being expanded in the lateral direction just behind the head pipe 3, a pair of left and right center frame members 8 connected to the rear end portions of the tank rails 7 so as to extend almost vertically, and a pair of left and right seat rails 9 extending backward from the rear upper ends of the center frame members 8.

A fuel tank 10 is arranged above the tank rails 7, and a rider's seat 11 is arranged above the seat rails 9. Furthermore, at the lower portions of the center of the center frames 8, is mounted a pivot (shaft) 12 to which swing arms 13 are pivoted so as to be freely swingable thereabout. Further, at the rear ends of the swing arms 13, a rear wheel 14 is rotatably supported.

In this motorcycle 1, the front portion of the body is covered by a cowling 15 having a streamline shape to reduce an air resistance caused at a time of running and to protect the rider from the wind pressure while running.

Figure 2:
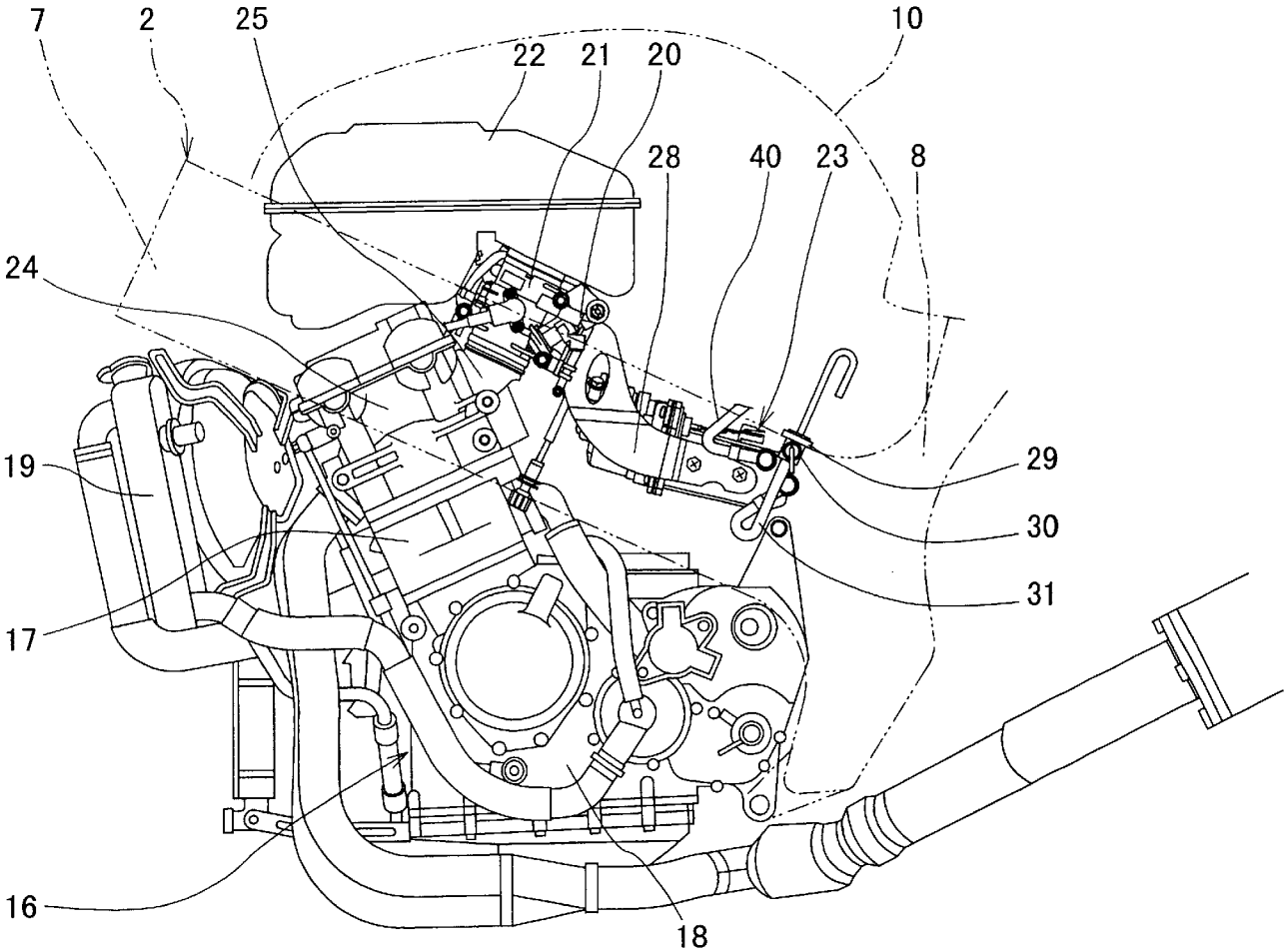
FIG. 2 is a left side view of a central portion of a motorcycle body with a cowling thereof being removed (first arrangement example of a fuel pump unit)
Figure 3:
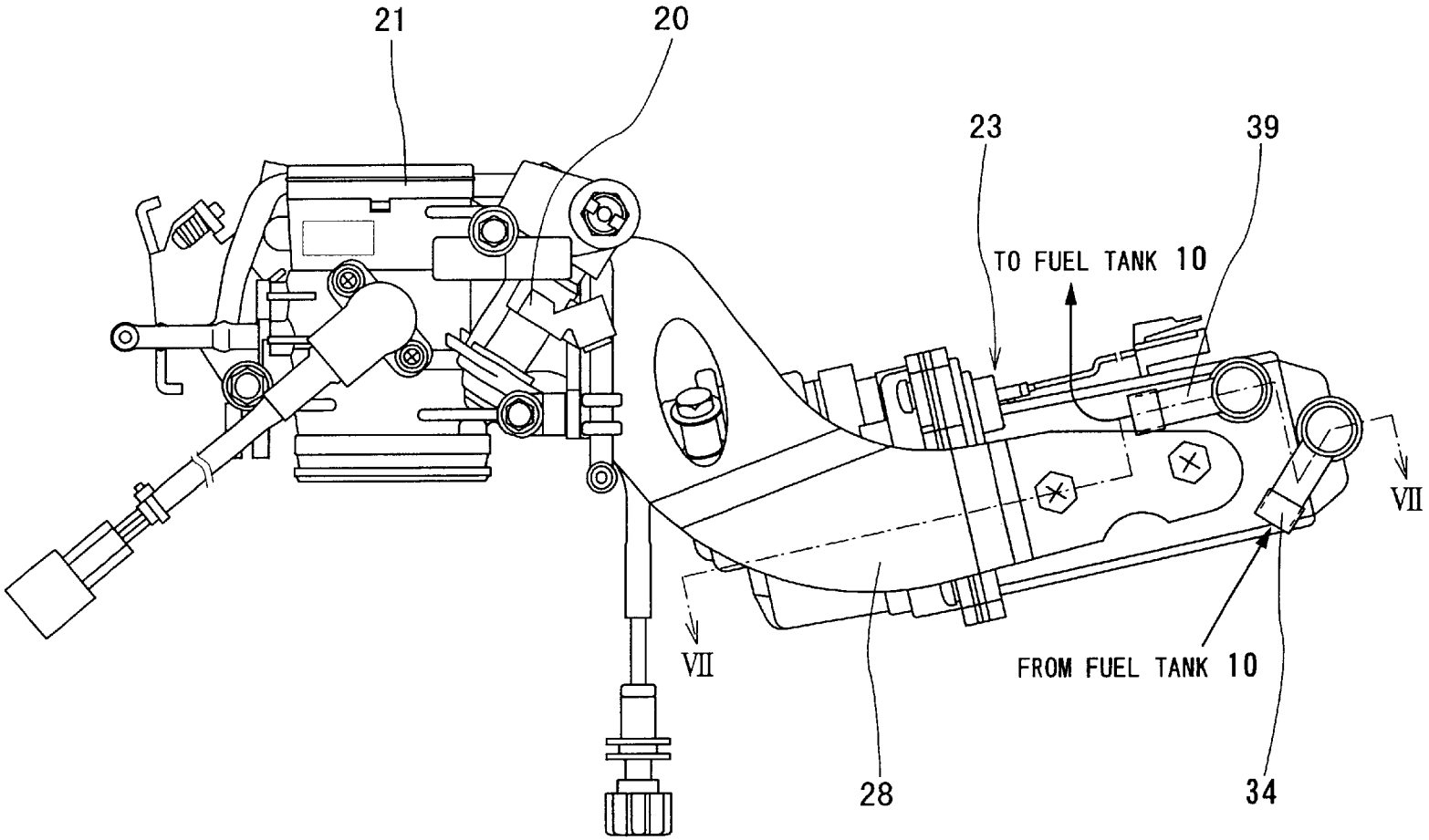
FIG. 3 is a left side view of a throttle body and a fuel pump.

FIG. 2 is a left side view of the central portion of the motorcycle body in the state where the cowling 15 is removed. As shown in FIG. 1 and FIG. 2, an engine or engine unit 16 is arranged at the lower portion of the center of the motorcycle body between the front and rear wheels 4 and 14 under the fuel tank 10. This engine 16 is, for example, a water-cooling type parallel four cylinder engine, and four cylinder assemblies 17 (hereunder, which may be called merely cylinders or cylinder assembly) are arranged in the width direction of the motorcycle body in the state of being slightly inclined forward at the upper portion of a crankcase 18. Furthermore, a radiator 19 for cooling the engine 16 is arranged in front of the engine 16 under the head pipe 3.

To each of the cylinder assemblies 17, an air-fuel mixture supply means (hereunder, may be called mixture supply means) is connected. The mixture air supply means used in this motorcycle 1 is a means of a fuel injection type having a throttle body 21 as a main component thereof provided with a fuel injector 20. The mixture air supply means is arranged between the lower portion of the fuel tank 10 and the upper portion of the engine 16 and provided with an air cleaner 22 connected on the upstream side of each throttle body 21 and a fuel pump 23 for forcibly feeding the fuel in the fuel tank 10 to the fuel injector 20.

Figure 4:
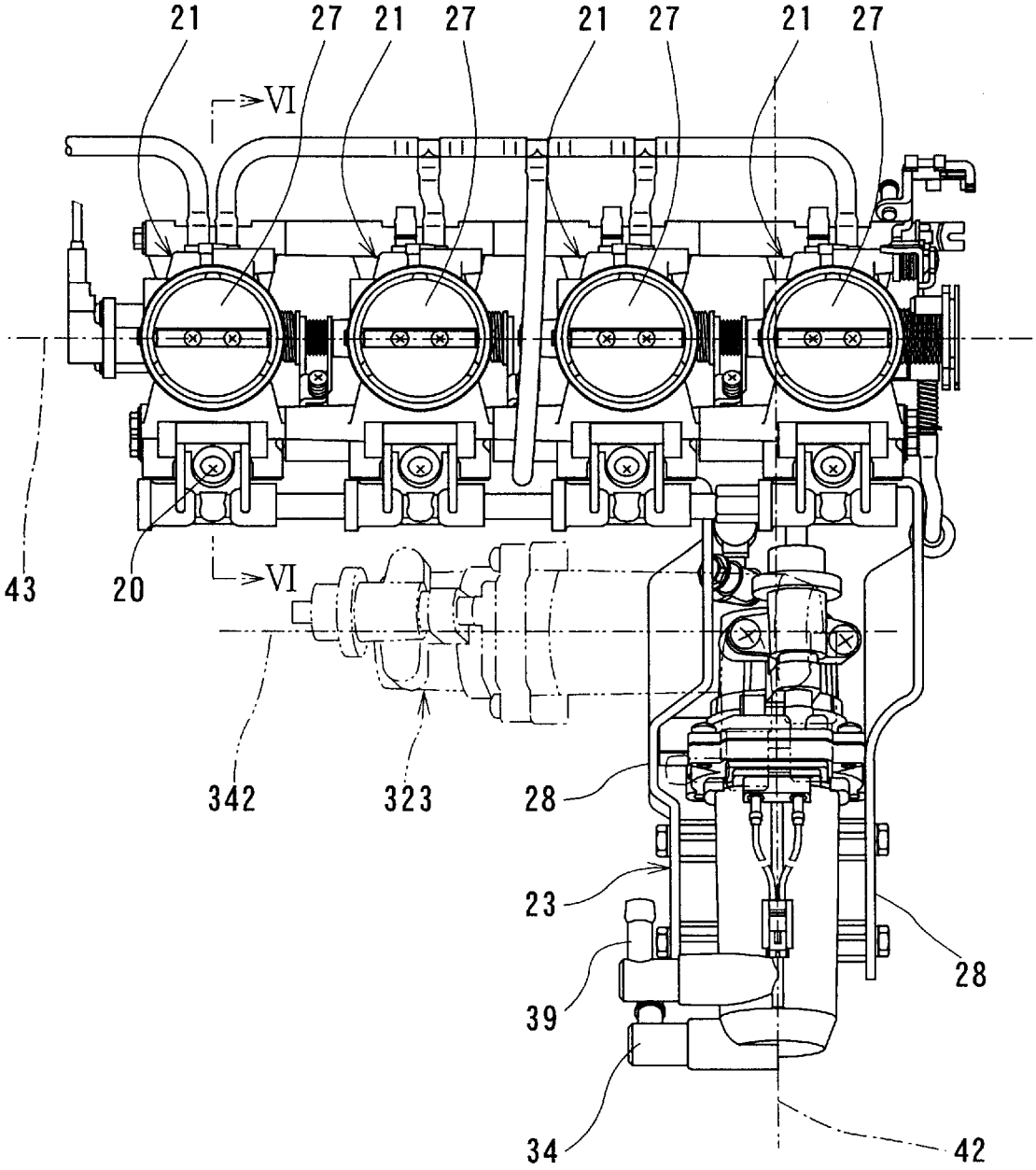
FIG. 4 is a plan view of the throttle body and the fuel pump.
Figure 5:
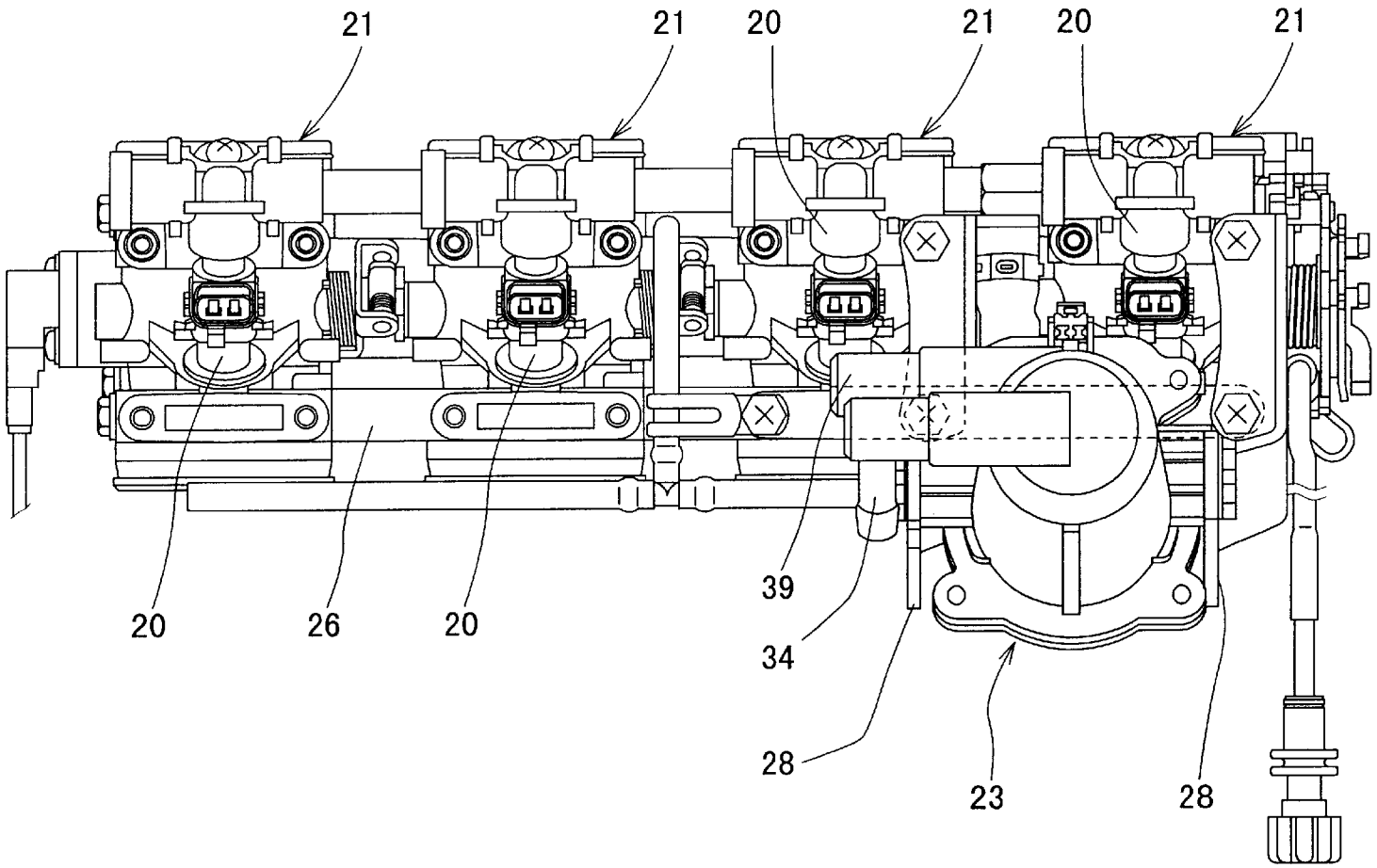
FIG. 5 is a rear side view of the throttle body and the fuel pump.

With reference to FIGS. 2 to 5, an intake port 25 is formed for each of the cylinder assemblies 17 at the rear portion of a cylinder head 24 provided at the upper portion of each cylinder assembly 17, and the throttle body 21 provided with the fuel injector 20 is connected to each intake port 25. The throttle bodies 21 are integrally connected by means of a connection plate 26 as shown in FIG. 5.

Figure 6:
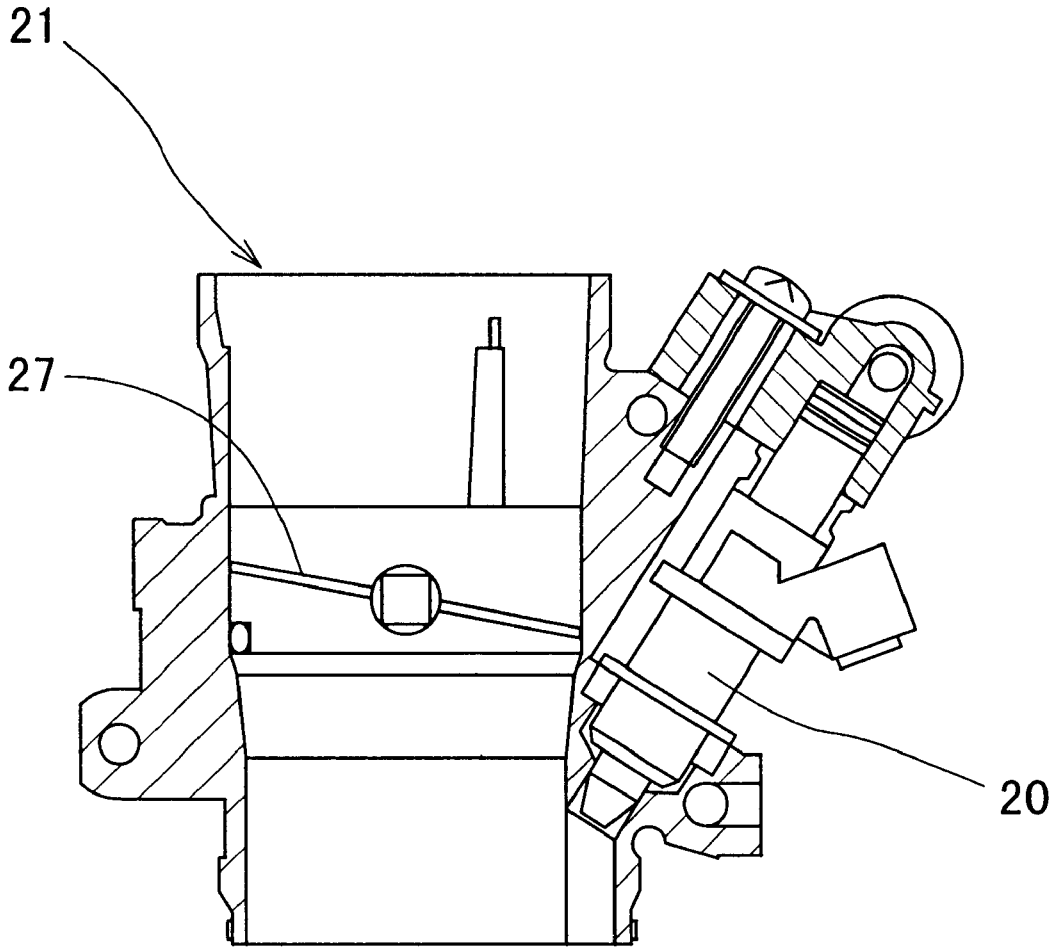
FIG. 6 is a cross sectional view taken along the line VI—VI in FIG. 4.

Furthermore, as shown in FIG. 6, each throttle body 21 has a throttle valve 27 disposed in an intake passage thereof, and on the down stream side of the throttle valve 27, the fuel injector 20 for directly injecting the fuel is integrally mounted. The fuel pump 23 is arranged behind the throttle body 21 through a stay 28 integrally extending from the connection plate 26.

As shown in FIG. 2, a fuel outlet 29 is provided near the lowermost portion of the fuel tank 10, and the fuel in the fuel tank 10 is guided to the fuel pump 23 through a fuel hose 31 from a fuel cock 30 provided at this outlet 29.

Figure 7:
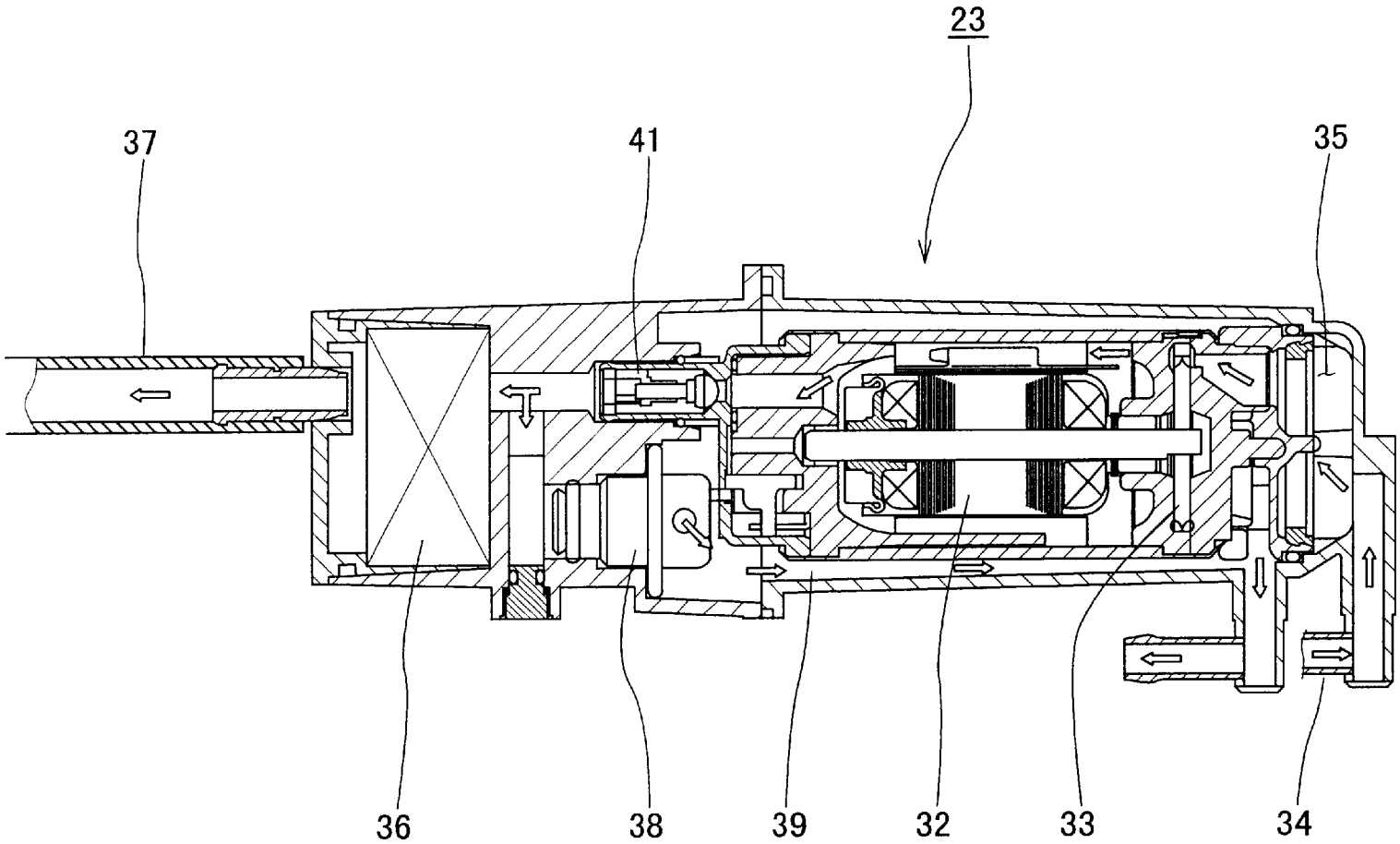
FIG. 7 is a cross sectional view of the fuel pump taken along the line VII—VII in FIG. 3.

Next, with reference to FIG. 7, a motor 32 and a pump means 33 such as an impeller driven by this motor 32 are contained in the fuel pump 23, and through the operation of the pump means 33, the fuel in the fuel tank 10 is guided into a suction (in-take) chamber 35 in the fuel pump 23 from a fuel inlet 34 provided on one side of the fuel pump 23, for example, on the right side in FIG. 7. Then, the fuel in the suction chamber 35 is forcibly fed to the other side of the fuel pump 23, for example, to the left side in FIG. 7 by the pump means 33, and after being filtered by a filter 36, the fuel is guided to each fuel injector 20 through a high pressure hose 37 as shown by white arrows in FIG. 7.

Between the pump means 33 in the fuel pump 23 and the filter 36, a pressure regulator 38 is provided, which is constituted so that when the fuel discharge pressure of the pump means 33 rises to a predetermined value or more, the pressure regulator 38 is opened and the excessive fuel is restored in the fuel tank 10 through a return passage 39 and a return hose 40 (refer to FIG. 2) to keep the pressure of fuel constant. Furthermore, between the pump means 33 and the pressure regulator 38, a check valve 41 is also provided, which is constituted so that the excessive fuel does not flow back to the pump means 33 side.

Hereunder, the arrangement of the fuel pump unit will be described.

In a first arrangement, as shown in FIG. 2 to FIG. 5, the fuel pump 23 is arranged so that a longitudinal axis 42 thereof is at right angles with a row 43 of the cylinder assemblies 17 (refer to FIG. 4,) and the fuel pump 23 is arranged to a lower backward portion so that the fuel inlet 34 thereof is positioned near the fuel outlet 29 at the lowermost portion of the fuel tank 10 and below the fuel outlet 29.

Figure 8:
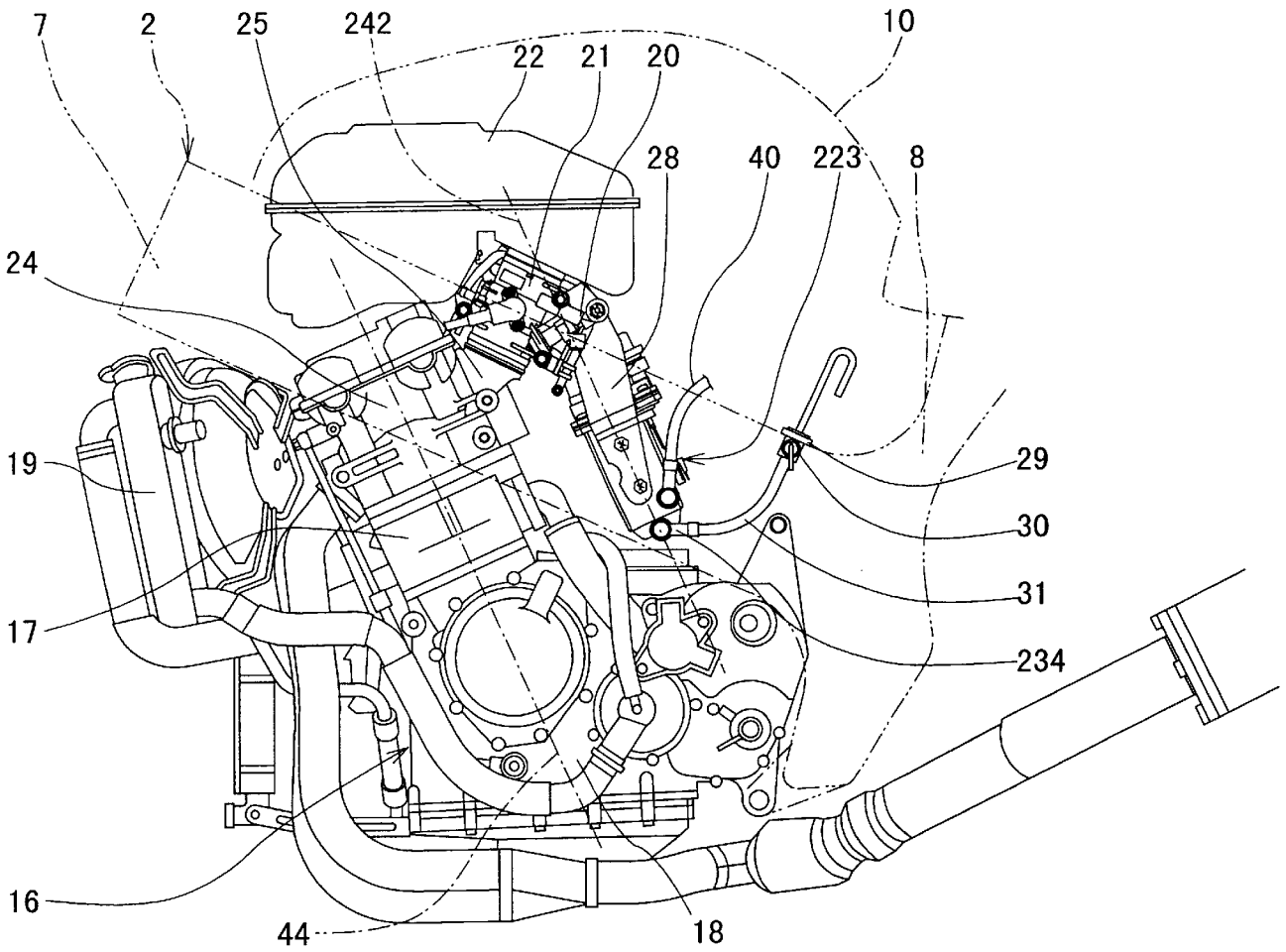
FIG. 8 is a left side view of the central portion of a motorcycle body showing a second arrangement example of a fuel pump unit.

In a second arrangement of the fuel pump, as shown in FIG. 8, the fuel pump 223 is arranged so that a longitudinal axis 242 thereof is almost in parallel with an axis 44 of the cylinder assembly 17, and the fuel pump 223 is arranged so that a fuel inlet 234 thereof is positioned at the lowermost portion.

Figure 9:
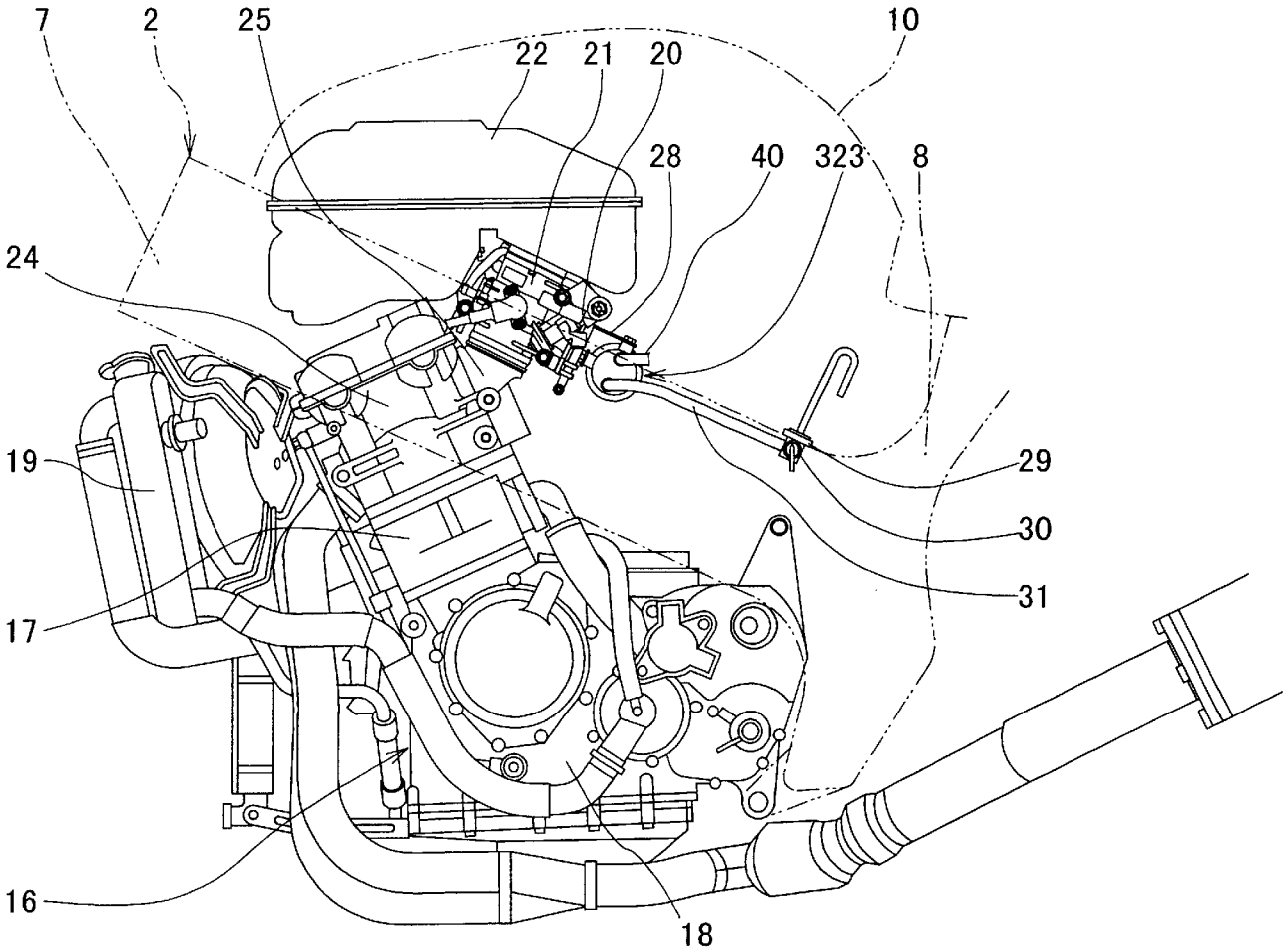
FIG. 9 is a left side view of the central portion of a motorcycle body showing a third arrangement example of a fuel pump unit.

In a third arrangement of the fuel pump unit, as shown in FIG. 4 and FIG. 9, the fuel pump 323 is arranged so that a longitudinal axis 342 thereof is almost in parallel with a row 43 of the cylinder assemblies 17 (refer to the two-dot chain line in FIG. 4).

Next, the operation of the fuel pump of present embodiment will be described.

Since the fuel pump 23 is not arranged inside the fuel tank 10 but is arranged outside the fuel tank 10, the shape of the fuel tank 10 and the layout are not limited, and the inner volume of the fuel tank 10 is not decreased, and it is also unnecessary to consider the sealing performance between the fuel tank 10 and the fuel pump 23.

Furthermore, since the fuel pump 23 is arranged behind the throttle body 21, the high pressure hose 37 can be made short, and the air tightness in the fuel pump 23 can easily be kept. Furthermore, the layout of the high pressure hose 37 is made also simple, and in addition, the total cost can be reduced.

Furthermore, a plurality of throttle bodies 21 are integrally connected by the connection plate 26 and the fuel pump 23 is attached to the throttle bodies 21 through the stay 28 integrally extending from the connection plate 26, so that the throttle bodies 21 and the fuel pump 23 are unitized thereby to effectively improve the performance of maintenance thereof. Still furthermore, since the fuel pump 23 is not attached to the body frame 2 but is attached to the throttle body 21, the body frame 2 can be made light-weight, and the degree of mounting freedom is hence increased in the installation position and direction of the fuel pump 23, and it is also possible to compensate or correct the weight balance of the engine 16 by the change of the installation position of the fuel pump 23.

Still furthermore, since the pressure regulator 38 is arranged in the fuel pump 23 to supply the fuel to the injector 20 after regulating the pressure of the fuel in advance, the long complex piping, which has been required in the prior art, becomes unnecessary, and in addition, the amount of the injection fuel is made stable and the lifetime of the fuel injector 20 is made long.

Incidentally, since the fuel pump 323 is arranged so that a longitudinal axis 342 thereof is made almost parallel with a row 43 of the cylinder assemblies 17, the space behind and under the fuel pump 323 is expanded, and the degree of freedom for the mounting is hence increased in the shape of the fuel tank 10, and in addition, the degree of freedom in the layout of the upper surface of the crankcase 18 (for example, of a breather chamber or a starter motor, not shown) is also increased.

Furthermore, since the fuel pump 223 is arranged so that a longitudinal axis 242 thereof is made almost parallel with an axis 44 of the cylinder assemblies 17, the space behind the fuel pump 223 is expanded, and the degree of freedom is hence increased in the shape of the fuel tank 10, and in addition, the fuel inlet 234 of the fuel pump 223 can be arranged in the lowermost position, and as a result, the fuel inlet 34 is positioned below the fuel outlet 29 of the fuel tank 10, and the suction chamber 35 of the fuel pump 223 is filled up with the fuel at all times, and therefore, the fuel can stably be supplied even though the output of the motor 32 of the fuel pump 223 is small.

Furthermore, since the fuel pump 23 is arranged so that a longitudinal axis 42 thereof is arranged at right angles with a row 43 of the cylinder assemblies 17, the space under the fuel pump 23 is expanded, and the degree of freedom in the layout of the upper surface of the crankcase 18 is therefore increased. In addition, the fuel inlet 34 of the fuel pump 23 is arranged at the lowermost position, and as a result, the fuel inlet 34 is positioned below the fuel outlet 29 of the fuel tank 10, and the fuel can stably be supplied even though the output of the motor 32 of the fuel pump 23 is small. Furthermore, since the fuel inlet 34 of the fuel pump 23 goes away from the cylinder assembly 17, the vapor lock of the fuel in the fuel inlet 34 due to the heat transferred from the engine 16 can be prevented, and the hose 31 connecting the fuel inlet 34 and the fuel cock 30 can be made short.

Incidentally, in the above embodiments, the example in which the fuel pump 23 is used in a four cylinder engine 16 has been shown, but the fuel pump 23 according to the present invention may be applied to a single cylinder engine, a two cylinder engine or the like regardless of the number of cylinders of an engine.

It is to be noted that the present invention is not limited to the described embodiments and many other changes and modifications may be made without departing from the scopes of the appended claims.

What is claimed is:

1. A fuel pump unit of a motorcycle in which an engine is arranged at a lower portion of substantially a center portion of a motorcycle body between a front wheel and a rear wheel and a fuel tank is arranged above the engine, wherein the engine is formed, at a rear portion thereof, with an intake port to which an air-fuel mixture supply means is connected and a fuel pump for supplying fuel in the fuel tank to the air-fuel mixture supply means is attached integrally to the air-fuel mixture supply means.

2. A fuel pump unit of a motorcycle according to claim 1, wherein the engine has a plurality of cylinders to which the intake ports are formed, respectively, and the air-fuel mixture supply means is connected to the intake port formed to each cylinder.

3. A fuel pump unit of a motorcycle according to claim 2, wherein a plurality of air-fuel mixture supply means are integrally connected by a connection plate and the fuel pump is mounted integrally to the air-fuel mixture supply means through a stay extending from the connection plate.

4. A fuel pump unit of a motorcycle according to claim 1, wherein the air-fuel mixture supply means has a fuel injection type structure.

5. A fuel pump unit of a motorcycle according to claim 4, wherein the air-fuel mixture means is disposed between a lower portion of the fuel tank and the upper portion of the engine and comprises a throttle body provided with a fuel injector.

6. A fuel pump unit of a motorcycle according to claim 4, wherein the fuel pump is provided with a pressure regulator to regulate a pressure of the fuel and then to supply a fuel to the air-fuel mixture supply means.

7. A fuel pump unit of a motorcycle according to claim 1, wherein the engine has a plurality of cylinders to which the intake ports are formed and the fuel pump is arranged so that a longitudinal axis thereof is arranged substantially in parallel with a row of the plurality of cylinders.

8. A fuel pump unit of a motorcycle according to claim 1, wherein the engine has a plurality of cylinders to which the intake ports are formed and the fuel pump is arranged so that a longitudinal axis thereof is arranged substantially in parallel with an axis of the plurality of cylinders, said fuel pump being arranged so that a fuel inlet thereof is positioned to a lowermost position.

9. A fuel pump unit of a motorcycle according to claim 1, wherein the engine has a plurality of cylinders to which intake ports are formed and the fuel pump is arranged so that a longitudinal axis thereof is arranged substantially at right angles with a row of the plurality of cylinders, said fuel pump being arranged so as to be inclined backward downward so that a fuel inlet thereof is positioned to a lowermost position.

* * * * *